US011199380B1

(12) United States Patent
Ekhaus et al.

(10) Patent No.: US 11,199,380 B1
(45) **Date of Patent: *Dec. 14, 2021**

(54) RADIO FREQUENCY / ORTHOGONAL INTERFEROMETRY PROJECTILE FLIGHT NAVIGATION

(71) Applicant: BAE Systems Information and Electronic Systems Integration Inc., Nashua, NH (US)

(72) Inventors: Ira B. Ekhaus, Arlington, MA (US); Michael J. Choiniere, Merrimack, NH (US); Quang M. Lam, Fairfax, VA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 148 days.

This patent is subject to a terminal disclaimer.

(21) Appl. No.: 16/587,445

(22) Filed: Sep. 30, 2019

Related U.S. Application Data

(60) Provisional application No. 62/738,012, filed on Sep. 28, 2018, provisional application No. 62/738,024, filed on Sep. 28, 2018.

(51) Int. Cl.
*F41G 7/22* (2006.01)
*F41G 7/28* (2006.01)

(52) U.S. Cl.
CPC ..... *F41G 7/226* (2013.01); *F41G 7/224* (2013.01); *F41G 7/2226* (2013.01); *F41G 7/2286* (2013.01); *F41G 7/28* (2013.01)

(58) Field of Classification Search
CPC ..... F41G 7/22–24; F41G 7/28; F41G 7/008
See application file for complete search history.

(56) References Cited

U.S. PATENT DOCUMENTS

| | | | | |
|---|---|---|---|---|
| 4,509,052 | A * | 4/1985 | Cash | G01S 5/12 342/418 |
| 5,091,847 | A * | 2/1992 | Herbermann | G06F 11/1666 714/3 |
| 8,120,526 | B2 | 2/2012 | Holder | |
| 8,274,425 | B2 * | 9/2012 | Yeary | G01S 13/876 342/62 |
| 8,854,252 | B2 | 10/2014 | Holder | |
| 9,401,741 | B2 | 7/2016 | Holder et al. | |
| 9,696,418 | B2 | 7/2017 | Holder | |
| 10,571,224 | B2 * | 2/2020 | Holder | F41G 7/2266 |
| 2016/0327370 | A1 * | 11/2016 | Holder | G01S 13/003 |
| 2017/0314892 | A1 | 11/2017 | Holder | |
| 2017/0370678 | A1 * | 12/2017 | Holder | F41G 7/306 |
| 2018/0306563 | A1 * | 10/2018 | Lotan | F41G 7/2293 |
| 2019/0033440 | A1 * | 1/2019 | Boolos | G01S 13/42 |
| 2020/0191529 | A1 * | 6/2020 | Holder | F41G 7/2286 |

FOREIGN PATENT DOCUMENTS

WO 2007/016098 A2 2/2007

* cited by examiner

*Primary Examiner* — Matthew M Barker
(74) *Attorney, Agent, or Firm* — Scott J. Asmus; KPIP Law, PLLC

(57) ABSTRACT

The system and method of projectile flight management using a combination of radio frequency orthogonal interferometry for the long range navigation and guidance of one or more projectiles and a short range navigation and guidance system to provide for more accurate targeting, especially in GPS-denied and GPS-limited environments.

12 Claims, 10 Drawing Sheets

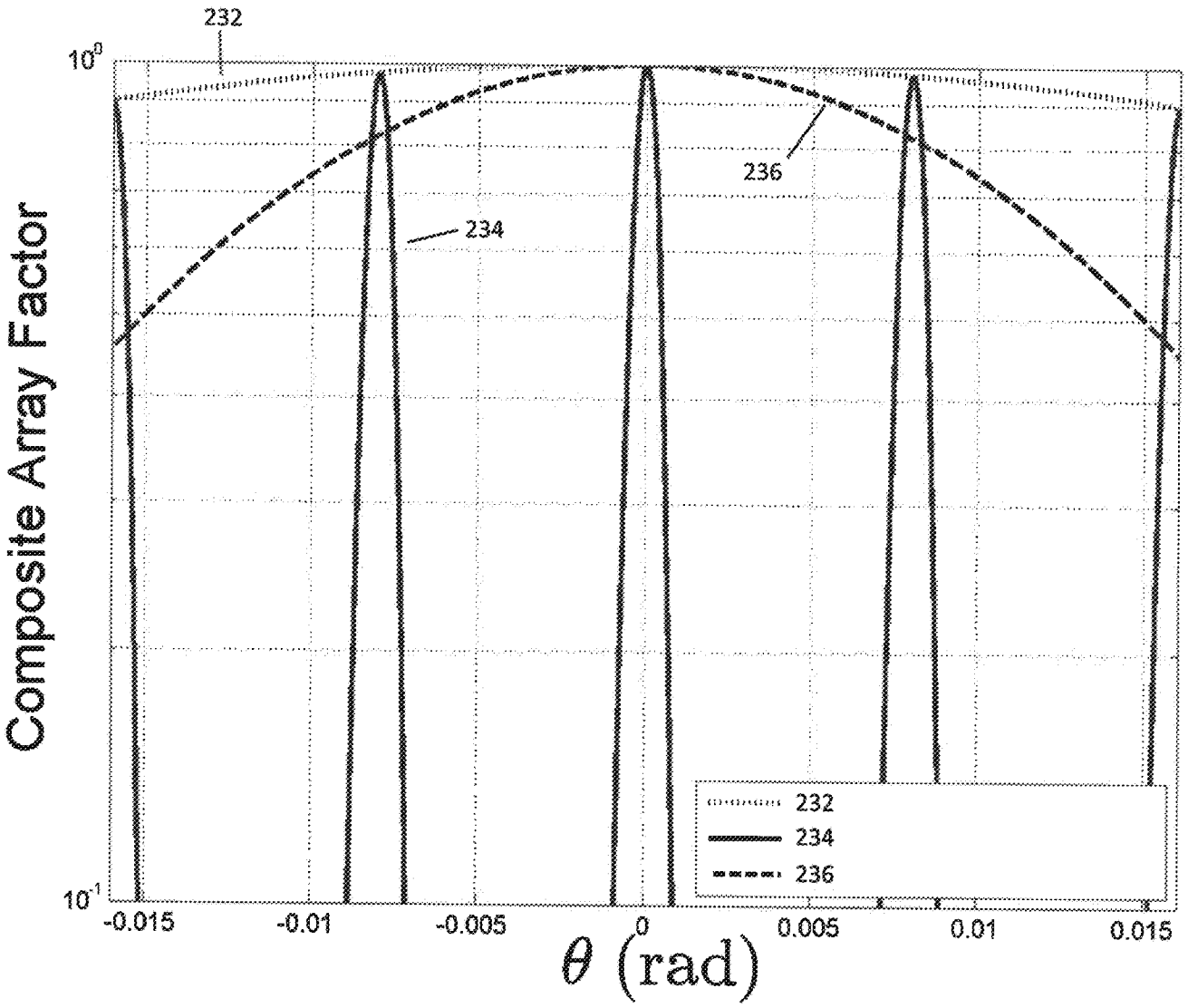
FIG 2.E

RADIO FREQUENCY / ORTHOGONAL INTERFEROMETRY PROJECTILE FLIGHT NAVIGATION

CROSS REFERENCE TO RELATED APPLICATIONS

This application claims the benefit from U.S. Provisional Patent Application No. 62/738,012, filed Sep. 28, 2018, and U.S. Provisional Patent Application No. 62/738,024, filed Sep. 28, 2018, the content of which is incorporated by reference herein its entirety.

FIELD OF THE DISCLOSURE

The present disclosure generally relates to accurately guiding projectiles and more particularly to guiding projectiles in GPS-denied or GPS-limited environments using at least partially radio frequency (RF)/orthogonal interferometry (OI) techniques.

BACKGROUND

The dominant approach currently used for guiding a weapon, projectile, UAV, or other similar asset is the global positioning system (GPS). The weapon, projectile, UAV, or the like measures its earth position in latitude, longitude, and altitude, to calculate and execute a trajectory towards a GPS located target. This approach has been in use for many years but is now becoming vulnerable to GPS jamming, both denied and spoofing. Other techniques to extend the GPS approach involve pseudolites, or pseudo-satellites, which are devices that are placed along the path to the target and which utilizes GPS-like transmissions to aid the navigation of the asset. One issue with this approach is the delivery/placement of the pseudolites along the path to the target. The risk to the installer is high given these pseudolites are typically in hostile regions and they are also susceptible to jamming since they are analogous to systems using GPS waveforms. Other pseudolite deployments utilize air platforms, which complicate the engagement logistically.

Wherefore it is an object of the present disclosure to overcome the above-mentioned shortcomings and drawbacks associated with conventional projectile guidance systems especially in GPS-denied and GPS-limited environments.

SUMMARY

It has been recognized that there is a need to replace or supplement GPS navigation with an improved guidance system for success in today's tactical environment. One aspect of the present disclosure is a navigation method within a GPS-denied or a GPS-limited environment that utilizes a local domain RF illuminator for projectile, such as a guided munition, artillery round, mortar, rail gun projectile, UAV, or other asset guidance that can be deployed away from an engagement area, whether ground, air or maritime based. In certain embodiments, the RF system provides GPS navigation-like performance, but is resistant to jamming, spoofing and the like.

One aspect of the present disclosure is a flight navigation system, comprising: a radio frequency orthogonal interferometry illuminator configured to generate a reference frame projected in the direction of a target area having radio frequency orthogonal interferometry waveforms and to further provide a radio frequency (RF) communications link having at least one of range information and mission information; at least one projectile configured to receive the radio frequency orthogonal interferometry waveforms and the at least one of range and mission information; a short range guidance system configured to provide guidance of the projectile from a hand-off point to the target area; and a non-transitory computer-readable storage medium carried by the projectile having a set of instructions encoded thereon that when executed by one or more processors, provide guidance and navigation of the projectile, the set of instructions being configured to perform: processing azimuth and elevation information from the radio frequency orthogonal interferometry waveforms; processing the at least one of range and mission information from the RF communications link; determining polar coordinates of the projectile using the azimuth, elevation and range information, wherein the polar coordinates are relative to the radio frequency orthogonal interferometry illuminator; guiding the projectile along a trajectory within the reference frame to the hand-off point; switching to the short range guidance system at the hand-off point; and guiding the projectile from the hand-off point to the target area using the short range guidance system.

In one embodiment, projectiles operate within the reference frame and are guided to a target. In one example the projectile, comprises: an antenna on the projectile wherein the projectile has a front portion and a rear portion and the antenna is oriented to be rear facing; a radio frequency (RF) receiver coupled to the antenna and configured to receive radio frequency orthogonal interferometry waveforms and RF communications including at least one of range and mission information; a guidance, navigation and control section processing the radio frequency orthogonal interferometry waveforms and RF communications to determine coordinates of the projectile and generate guidance instructions; a short range guidance system configured to provide guidance of the projectile from a hand-off point to a target area; a control actuation system executing the guidance instructions; and a warhead having a fuze that detonates the warhead proximate the target.

In one embodiment the projectile employs software/firmware and is a computer program product including one or more non-transitory machine-readable mediums with instructions encoded thereon, that when executed by one or more processors cause a process for guidance and control of one or more projectiles to be carried out, the process comprising: receiving mission data and range information from an RF communications link; processing, via a radio frequency (RF) receiver on the projectiles, radio frequency orthogonal interferometry waveforms obtained from a reference frame, the reference frame being generated by a radio frequency orthogonal interferometry illuminator; determining azimuth and elevation of the projectiles from the radio frequency orthogonal interferometry waveforms and further determining latitude and longitude of the projectiles using the range information; guiding the projectiles along a trajectory towards a target; switching guidance of the projectile to a short range guidance system at a hand-off point; guiding the projectiles to the target using the short range guidance system; and detonating the projectiles proximate the target.

One embodiment of the flight navigation system is wherein the distance from the target is about 100 km. Another embodiment of the flight navigation system is wherein the radio frequency orthogonal interferometry array accuracy is about ±5 m in range and about ±100 m in azimuth and elevation. In some cases, the hand off point is less than about 10 km.

Another embodiment of the flight navigation system is wherein a CEP-50 is about 30 m. In some embodiments, the short range guidance system is a semi-active laser seeker having a hand off error of less than 0.1 degree. In other embodiments, the short range guidance system is an image based homing and navigation system such as an image automatic target recognition system having a hand-off error of less than 50 to 300 meters depending on the control authority of the weapon and detection range of the image automatic target recognition system.

Yet another embodiment of the flight navigation system further comprises an inertial measurement unit (IMU) on the at least one airborne device configured to assist in guidance for the at least one airborne device during a terminal phase.

In certain embodiments, the at least one air borne device is two or more air borne devices and each air borne device receives unique target and guidance information. In some cases, each of the at least one air borne devices comprise an RF receiver, an on-board processor, a communication module, and at least one other detector for use in short range guidance. In one embodiment, the at least one other detector for use in short range guidance is only limited by line of sight (LOS) navigation to earth grid coordinates or in a relative local coordinate frame.

Still yet another embodiment of the flight navigation system is wherein due to control of a waveform, short pulse width, frequency and/or frequency hopping via a code of the moment coupled with a rear facing RF antenna/aperture, the system provides jam immunity. In some cases, the code of the moment is defined at launch and varies from launch to launch.

Another aspect of the present disclosure is a munition flight navigation method comprising: initiating a fire command via a fire control system; loading and firing at least one munition; powering up the at least one munition after launch; powering up a radio frequency orthogonal interferometry (RF/OI) array, wherein the radio frequency orthogonal interferometry array is aligned via a north finding device, the radio frequency orthogonal interferometry array providing a reference frame, via a projected grid, in the direction of a target area; receiving target location and waveform mission code information, at the at least one munition, from an RF communications link; collecting, via a RF/OI detector on the at least one munition, unique waveform data from the radio frequency orthogonal interferometry array; determining via a processor on the at least one munition, azimuth, elevation and range data for the at least one munition via the RF/OI detector; powering up a short range guidance system located on each of the at least one munition; designating a target via each short range guidance system; calculating target navigation waypoints for respective short range handoff for each of the at least one munition; handing off guidance from the RF/OI array to a respective short range guidance system for each of the at least one munition; guiding the at least one munition to the target via the respective short range guidance system; and signaling the detonation of the at least one munition.

In certain embodiments, the munition flight navigation method further comprises utilizing a RF communications link to a plurality of munitions, wherein each munition comprises a RF receiver and a navigation processor navigating to the target either directly or via a short range handoff.

Another embodiment of the munition flight navigation method further comprises controlling a waveform, short pulse width, frequency and/or frequency hopping coupled with a rear facing RF antenna/aperture provides jam immunity. In some cases, the code of the moment is defined at launch and varies from launch to launch.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

FIG. 2E shows a zoomed in view of the product of the real beam pattern and electrically large interferometric ambiguity of FIG. 2D.

DETAILED DESCRIPTION

In one embodiment of the system of the present disclosure, a Radio Frequency (RF) Orthogonal Interferometry (also referred to as Orthogonal Interferometer) (OI) illuminator or transmitter is located at some position from the weapon system (e.g., at 0 to 100 km) and an RF receiver is mounted on an asset and receives the OI waveforms (distinguishable waveforms referenced to respective phase centers) to determine azimuth and elevation and to receive range information from an RF communications link in order to guide the asset to a target. In some embodiments, the azimuth and elevation information has an accuracy of about 100 to 300 μrads depending on the transmitter configuration. In some cases, the system range information has an accuracy of about +/−20 to 40 meters depending on various system operating parameters. In certain embodiments, the asset is given the target's location prior to launch or via RF or other communications link after launch within the RF/OI frame of reference. The asset in one example has on-board processing capability and calculates the trajectory for the target intercept using on-board guidance laws on and on-board processor.

The approach to local domain guidance control of the present disclosure allows the user to deploy an RF/OI illumination system anywhere in the world given the portability of the system (e.g., it fits on a small utility trailer), the system's range>100 km, and the system's accuracy. This system's performance is similar in some respects to the GPS systems, but has the added benefit of jam resistance due to features such as the use of custom coding of the RF/OI waveform, the illuminator's signal strength, the deployment geometry, and the antenna configurations. Unlike the GPS navigation waveforms which are published, the RF/OI illumination system would not be public. The system operator could select frequency, Pulse Repetition Interval (PRI) and pulse duration, and other parameters. For example, the control of the waveform properties including pulse width, frequency and/or frequency hopping are used by the illuminator to mitigate jamming. Assuming a 100 nanosecond pulse, frequency hopping with varying PRI could be utilized in a code format loaded prior to launch or during flight. In addition, the rearward looking antenna on the projectile provides receiver isolation from any jammers forward or below the projectile. The combination waveform control and antenna spatial selectivity provides counter measure immunity or mitigation. The RF/OI illumination system is also difficult to detect. As an example, ground based jammers have the additional burden of being direct line of sight of the RF/OI illuminator, thereby making detecting its presence difficult due to the curvature of the earth.

Figure 1A:
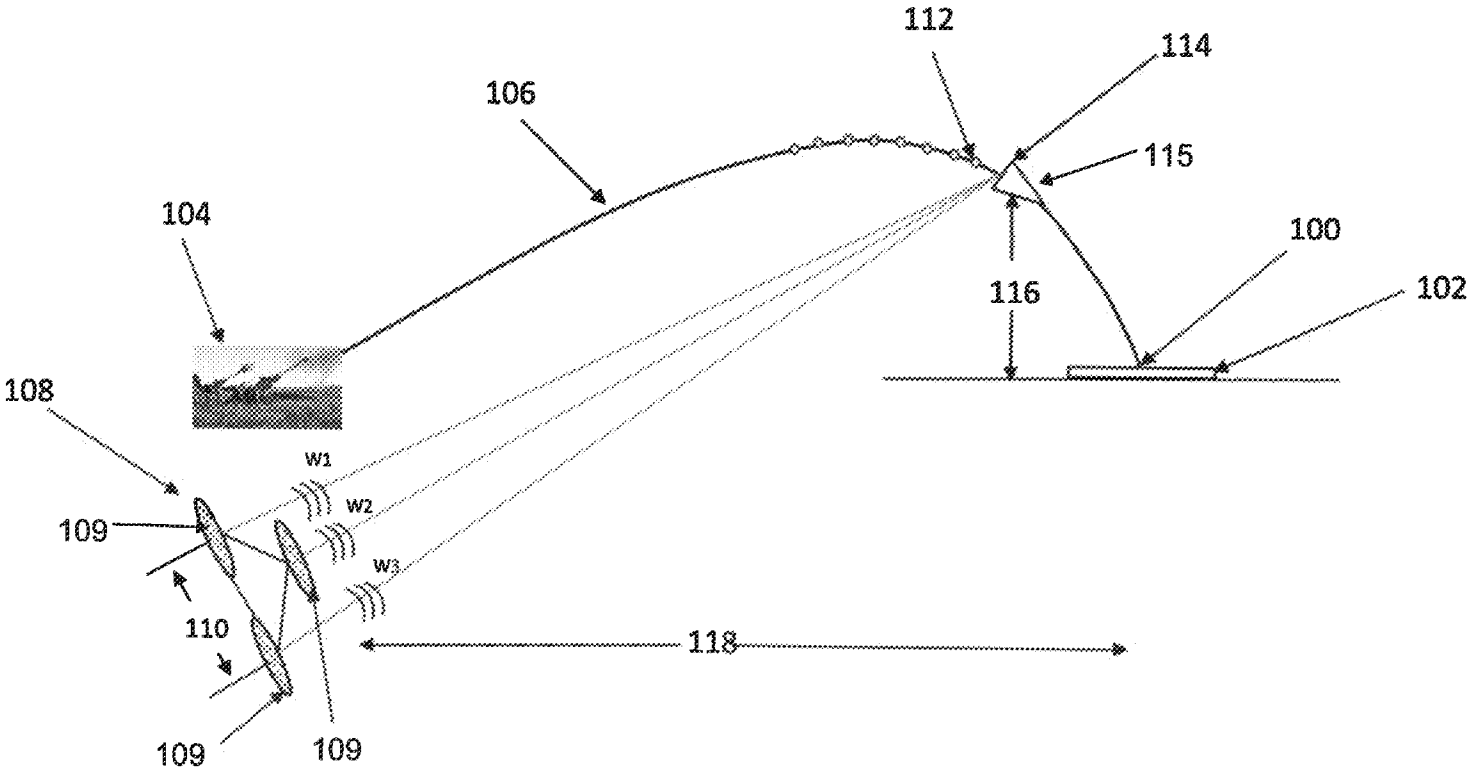
FIG. 1A is a diagram of one embodiment of the system of the present disclosure.

Referring to FIG. 1A, a diagram of one embodiment of the system of the present disclosure is shown. More specifically, at least one asset 115 is launched from a launch area 104 and the at least one asset 115 is directed at a target 100 some distance away 118 from the launch area 104. In some cases, the distance 118 is about 200 km. After launch, the asset 115 (e.g., munition, projectile, etc.) travels along a trajectory 106 toward the target 100. A circular error probable (CEP-50) 102 is defined as a circular area having a radius that encompasses where 50% of the assets land. CEP-50 is a common measure of accuracy for ballistics. In certain embodiments of the system of the present disclosure, the CEP-50 102 is about 30 m. In some cases, the CEP-50 102 is limited by the performance of the air frame, its limited control authority, the asset's ability to perform high G maneuvers, and the like.

Still referring to FIG. 1A, a radio frequency (RF)/Orthogonal Interferometry (OI) illuminator 108 is used to guide the one or more assets to the target. In one embodiment, the RF array comprises three active electronically scanned array (AESA) panels 109, where an AESA is one type of phased array antenna that is computer-controlled. There, the RF waves may be electronically steered to point in different directions without physically moving the antenna such as by leveraging the many antenna elements in the array.

In some embodiments of the system of the present disclosure, the array panels can also move. In one embodiment, the RF array is compact, with dimensions 110 of about 1.5 m×1.5 m×0.75 m. The AESA panels 109 are typically located proximate each other with some separation. The number of panels can vary depending upon the desired accuracy and redundancy.

In some embodiments, the RF array 108 guides (and tracks if equipped with fire control system) the one or more assets 115 along the trajectory 106 with accuracy of about ±5 m range and ±10 m azimuth and elevation 112. In certain embodiments, the RF array uses orthogonal interferometry (OI) methods to project a reference frame, or a projected grid, which is analogous to a polar coordinate azimuth and elevation for the three dimensional space. The polar coordinates can be can be mapped to standard grid coordinates—latitude and longitude. In one example, the RF/OI illuminator system 108 produces a reference frame that is aligned using a north finding device such as a gyro, or the like, such that the one or more projectiles or assets 115 do not require separate north finding capabilities. In this case a single north finding device can be leveraged for multiple assets such as a swarm. The north finding device is intended to obtain a reference point for the further processing. This also tempers the need for precise alignment of the assets—center mass aiming—and thus, minimizes operator processing time and resources. In certain embodiments, the RF/OI system can provide 10°, 20°, or 30° fields of engagement. In some embodiments, the system provides for adjustable accuracy/guidance precision based, in part, on the RF/OI transmit power, antenna spacing, and deployment angle, where the cross range accuracy is equal to angular resolution times range. Thus the present system operates in GPS denied environments with minimal likelihood of being jammed or spoofed Additionally, the system of the present disclosure provides a means to precisely measure and subsequently correct trajectory variations due to the varying energetics and the cross wind impact of each of the one or more projectiles by maintaining the desired trajectory using the RF/OI system array as a stable and precise frame of reference for long range position and projectile guidance. This technique reduces the complexity and the cost of the control actuator system (CAS) by simplifying the components needed on the projectiles. The control actuation system in one example provide fins or canards with controllers that enable changes to the flight of the asset. In some cases, an RF receiver and RF apertures are present on each round. In some cases, by using the RF/OI system, no azimuth aiming is required and minimal elevation adjustment is needed for each projectile, thus allowing the flight navigation system to make the course corrections accounting for the range differential due to energetics and aiming errors. The projectile in one example is a small rocket or artillery round having a warhead, a fuse, a control actuation system, guidance and navigation system, and a rocket engine. The guidance and navigation section in one embodiment includes a rear facing antenna/aperture, RF receiver, control actuation system, and a short range guidance system. The short range guidance system detector can include at least one detector such as a semi-active laser seeker or imaging system. Alternatively, the short range guidance system can be an inertial measurement unit that provides orientation and enables the asset to continue its trajectory to the target.

In one embodiment of the system of the present disclosure, the RF/OI system 108 "hands off" the positioning and guidance of the one or more projectiles at a certain hand-off point 114. Hand off refers to a transition point from the use of the RF/OI guidance to a secondary form of guidance, to increase the accuracy of the projectile. In some cases, the hand-off point 114 is about 6 km to about 10 km from the target 100 along the flight path. In some cases, the hand-off point 114 is located a distance above a plane 116 within which the target is located. In some cases the distance 116 is about two km to about three km above the plane. In some cases, the target is on land. In some other cases the target is on the surface of water. The hand-off can be accomplished as a timed event starting from launch or the hand-off can be event driven. In certain embodiments, an event driven hand-off may be when a short range guidance system (e.g., a semi-active laser or image seeker) detects the target and initiates terminal guidance.

The navigation approach of the present disclosure can be adapted for airborne assets, such as a UAV, and would use a tracking subsystem on the ground providing target location updates to the UAV. The RF receiver on the UAV can determine the relative azimuth and elevation coordinates from the illumination system. The RF uplink can be coded to determine range via a range tracking filter in conjunction with a time synchronization scheme. The information is processed and translates the polar coordinates, azimuth, elevation and range to grid (e.g., latitude and longitude) given the orientation of the illumination relative to latitude, longitude coordinates.

In certain embodiments, the hand-off is from the RF/OI array to a semi-active laser (SAL) seeker. In some cases, each of the one or more projectiles has a unique SAL hand-off associated with it such as the operating range and based on the distance to the target. In certain cases, the hand-off error is less than 0.1 degree. In some embodiments of the present disclosure, a SAL seeker is located on the front or midsection of the asset and the asset is guided by a designator (laser) coming from a forward observer on the ground, a UAV, or an aircraft. The use of coding technology in the SAL seeker mitigates false locks onto a second target where multiple designators are in the same engagement space or counter countermeasures (CCM) are being employed to defeat the weapon's accuracy. In some cases, the SAL seeker is capable of detection at 10 km with 1 mrad target angle error. In some embodiments, the SAL seeker has a field of view (FOV) ranging from about 40 to about 70 degrees.

While the present system provides operation in a GPS denied environment, in one example the asset includes a GPS receiver and can use the information from the GPS to enhance the targeting information. In a further example, the processing information form the RF/OI system detailed herein is utilized to confirm that the GPS data is accurate and not being spoofed. In one example, if the targeting data between the GPS and the RF/OI diverge beyond an acceptable amount, the system will disregard the GPS data and rely upon the RF/OI for targeting.

In other embodiments, the hand-off is to a low cost internal measurement unit (IMU) instead of the SAL seeker and this is used in the last stage prior to detonation. In one example the last stage is about 4-5 seconds. In some cases, IMU precision can be improved by determining the drift as compared to the RF receiver. The lower cost IMU can be calibrated during flight and thereby provides a higher level of performance when the RF/OI processing is no longer available such as due to line of sight issues.

In certain embodiments, the system is utilized for the deployed delivery of several or many artillery rounds in a grid pattern for area effects. The intent of the grid pattern is to uniformly cover an engagement area where the distance between round locations is more useful than the absolute placement of the group as a whole. In this manner, the grid pattern can be processed to indicate the number of rounds required for a certain level of impact and coverage of a region. In certain embodiments, the RF/OI illuminator provides sufficient guidance control up to the point where LOS hinders the RF/OI transmission and the artillery round trims and glides the ballistic toward the target. The guidance prior to loss of the RF/OI signals mitigates errors due to launch velocity, aiming error, and the majority of cross wind effects. Given the weight of the artillery round, very little error will be realized even when guidance is ended at two to four km above a target.

In still other embodiments, the hand-off is to an image-based homing and navigation system. In certain embodiments, a library of images exists for a given target area. The library is available to the one or more assets for guidance purposes and when one or more images in the library are matched to images from the field of view of the asset, once the asset is within a certain distance, the asset munition may be detonated. In some cases, automatic target recognition (ATR) is used. Generally, image-based methods are more effective for fixed targets, such as buildings, and the like. Wind and the energetics of launch can affect the trajectory of a munition but the RF/OI system, provides a precise positioning capability to the RF receiver, and is used, in part, to keep the correct steering for the munition until a short range guidance system takes over.

Figure 1B:
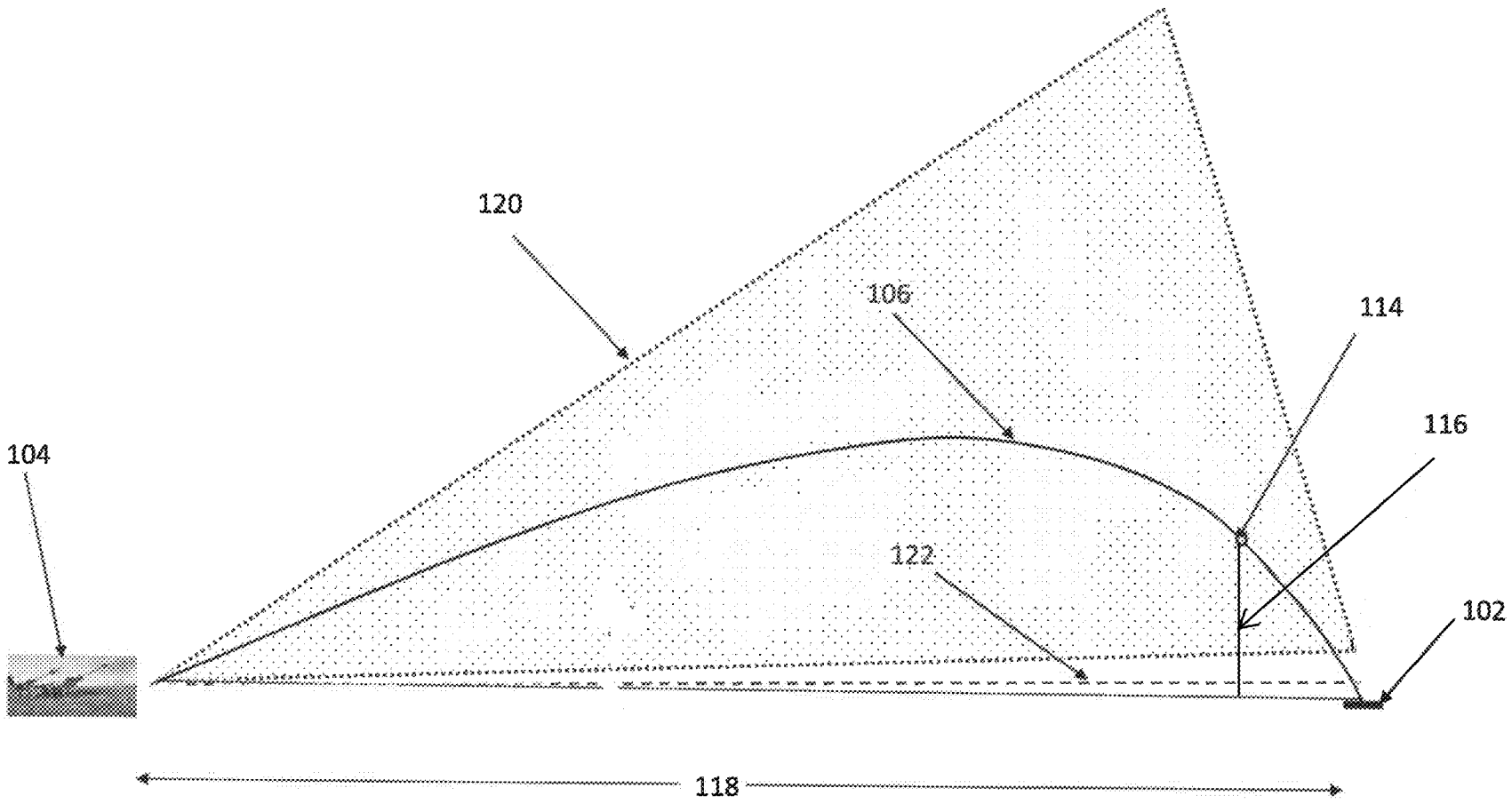
FIG. 1B is a diagram of one embodiment of the system of the present disclosure.

FIG. 1B depicts a diagram of one embodiment of the system of the present disclosure. More specifically, in this figure the RF/OI system is co-located with the launch point 104 for the one or more assets or projectiles (only one flight path is shown). In some cases, the RF/OI system is located well behind the launch point to provide protection for the RF/OI array. In some cases, the RF/OI system can be located a distance 118 from the target having a known CEP-50 102. In certain embodiments, the distance 118 is about 100 km and the CEP-50 is about 30 m. In contrast, a conventional radar system has range limitations for two-way radar, and may need to be forward deployed, thus placing the radar system in front of the launch area endangering the equipment by subjecting it to crossfire and or direct targeting by enemy forces.

As seen in FIG. 1B, the RF/OI system produces a RF reference frame 120. The munition trajectory 106 is located within that reference frame 120. The reference frame 120 does not require active scanning and thus provides for simplified flight control management. The reference frame 120 also provides for tracking of multiple rounds or projectiles at the same time by essentially projecting a grid in the air as a reference frame. The hand-off point 114, e.g., where a SAL seeker or IMU takes over the short range tracking and guidance for the one or more projectiles, is also shown and is also within the reference frame. In certain embodiments, RF communication links on each asset allows for programming the trajectory during flight for each asset, including, for example SAL codes. In some cases, the guidance for the asset begins at the moment of firing or early in the flight trajectory. With the present system, no pre-firing program or precise aiming of the weapon system is needed. Instead, guidance can be handled directly from a mission computer.

Still referring to FIG. 1B, the line of sight (LOS) 122 is limited over the distance 118 due to the curvature of the earth. In one embodiment, the distance above the plane of the target 116 for the LOS is about 800 m. In certain embodiments, the distance above the plane of the target 116 for the base of the RF reference frame is about 1400 m, thus making the hand-off point 114 at which terminal guidance is handled by a SAL seeker, or the like, very important for high accuracy in targeting. In some cases, a magnetometer inertial measurement unit (IMU) is used to supplement the guidance of the one or more projectiles or assets. Thus the hand-off point 114 needs to be located above the plane of the target 116. The maximum hand-off point is at the boundaries of the reference frame 120 after which the asset would not be able to obtain any further data from the illuminator.

The lack of LOS prevents the asset from seeing the RF/OI illuminator 108 below the horizon. In addition, the RF/OI receiver's waveform is controlled to mitigate multipath due to the earth and influencing the accuracy of the position measurement. Waveforms allow multipath mitigation and allow the receiver to post process the impact of multipath out of the position results. These techniques yield a safe zone of navigation that corresponds in one example to a slant angle of about 1 degree 90 from the RF/OI illuminator or a height restriction 116 which is range dependent.

Figure 2B:
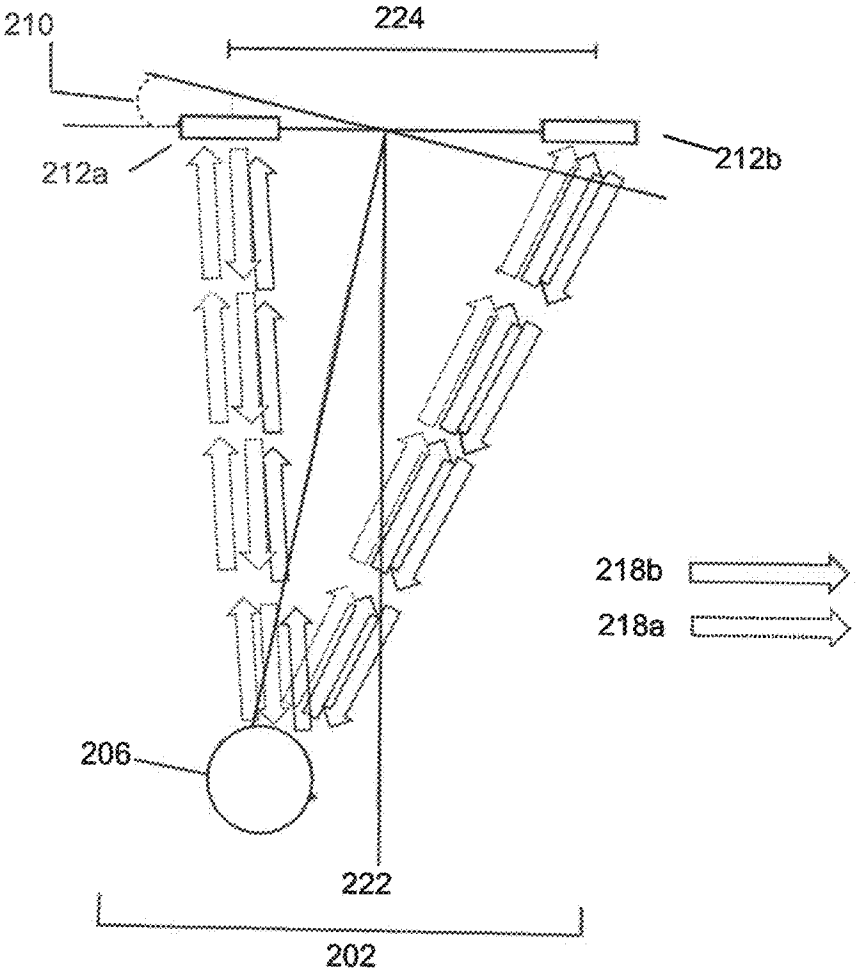
FIG. 2B is an orthogonal interferometer (OI) according to the principles of the present disclosure.
Figure 2A:
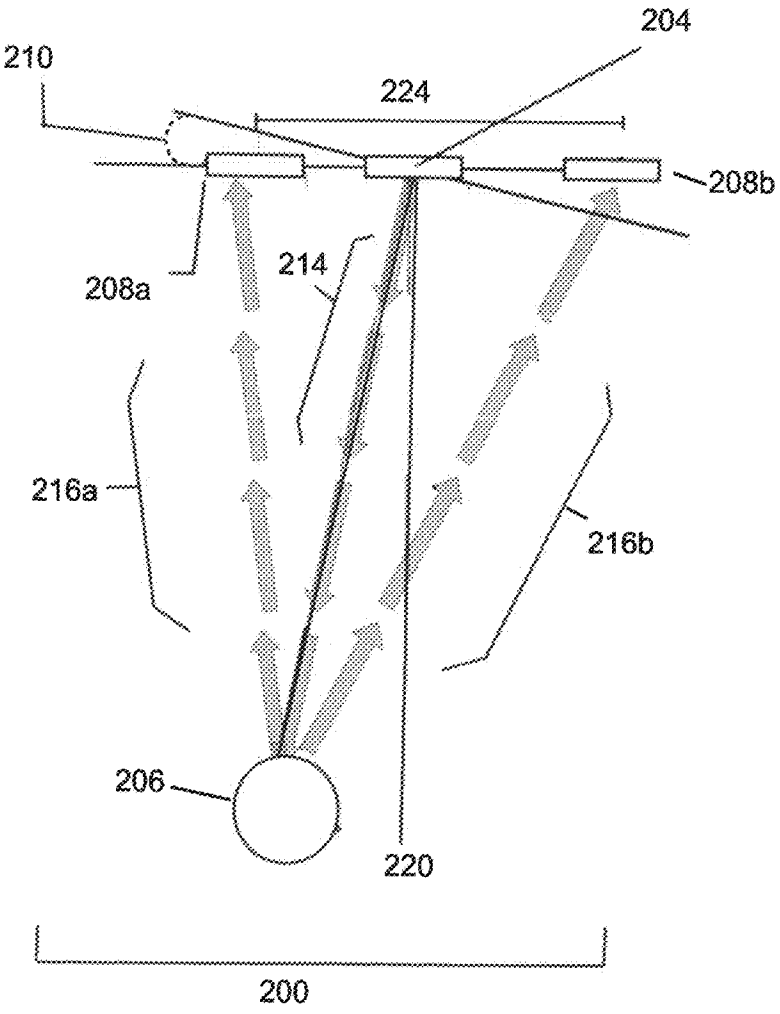
FIG. 2A is a conventional interferometer (CI) according to the principles of the present disclosure.

FIG. 2A and FIG. 2B compare simulations of the path lengths and system components of a conventional interferometer (CI) 200 and an Orthogonal Interferometer (OI) 202 for a notional two dimensional case. For a CI measurement, a transmitter 204 illuminates the target 206 and the phase of the returns at two separate receivers 208*a*, 208*b* provides a differential path length difference ($\Delta\phi$) that leads to a target angle estimate of $\theta$ 210. In the case of OI 202, two phase centers 212*a*, 212*b* each transmit orthogonal transmissions which are individually decorrelated on respective receptions. The fundamental concept behind the orthogonal interferometer is the use of at least two coherent transmit/receive antennas 212*a*, 212*b* that transmit nearly orthogonal coded waveforms. For example the orthogonal transmission from 212*a* travels to target 206 and returns to both transmit/receive antennas 212*a*, and 212*b*, this is shown by path 218*b*. Additionally an orthogonal transmission from 212*b* travels to target 206 and returns to both 212*a* and 212*b*, shown by path 218*b*. On reception, the separation of the signals is achieved by decoding against a particular code and exploiting the cross-correlation suppression of the orthogonal coded waveforms. Orthogonal coding in this sense can entail some combination of time, frequency and/or code modulation—as long as the receiver can perform a decorrelation and form an estimate of the received signal keyed to a particular transmit phase center.

As depicted the CI 200 case has a common transmit 214 and distinct receive paths 216*a*, 216*b* while the OI 202 case has distinct transmit and receive paths 218*a*, 218*b* at each receiver 212*a*, 212*b*. Decoding OI has achieved a double path length dependency which provides twice the target angle 210 sensitivity as compared to CI with an equivalent SNR. The phase difference relationship of an interferometry is defined as $$\Delta\phi = K_\phi \frac{D}{2\pi\lambda}\sin(\theta);\ K_\phi = 1(CI),\ 2(OI)$$

where D is the interferometer baseline (array phase center separation) 224, $\lambda$ is the nominal operating wavelength), and $K_\phi$ represents the phase gain factor that depends on path length. This expression highlights the physical advantage of a system with an electrically large baseline $$\left(\frac{D}{\lambda}\right)$$

in that it yields a greater $\Delta\phi$ for the same target offset $\theta$; the geometric "gain" of the larger interferometric baseline yields a larger $\Delta\phi$ relative to SNR dependent phase estimation noise $\sigma_{\Delta\phi}^2$ and provides a more precise measurement of $\theta$. In many signal processing applications the localized performance of an estimator can be bounded by the Cramer-Rao Lower Bound (CRLB). This bound on the $\theta$ estimation error for a CI radar or an OI radar is $$\sigma_\theta^{CI,OI} = \frac{\lambda}{K_\phi 2\pi D\sqrt{SNR}};\ K_\phi = 1(CI),\ 2(OI)$$

Note that for the same interferometer baseline (D) and same SNR the OI angle accuracy is a factor of two better than the CI angle accuracy.

Figure 2C:
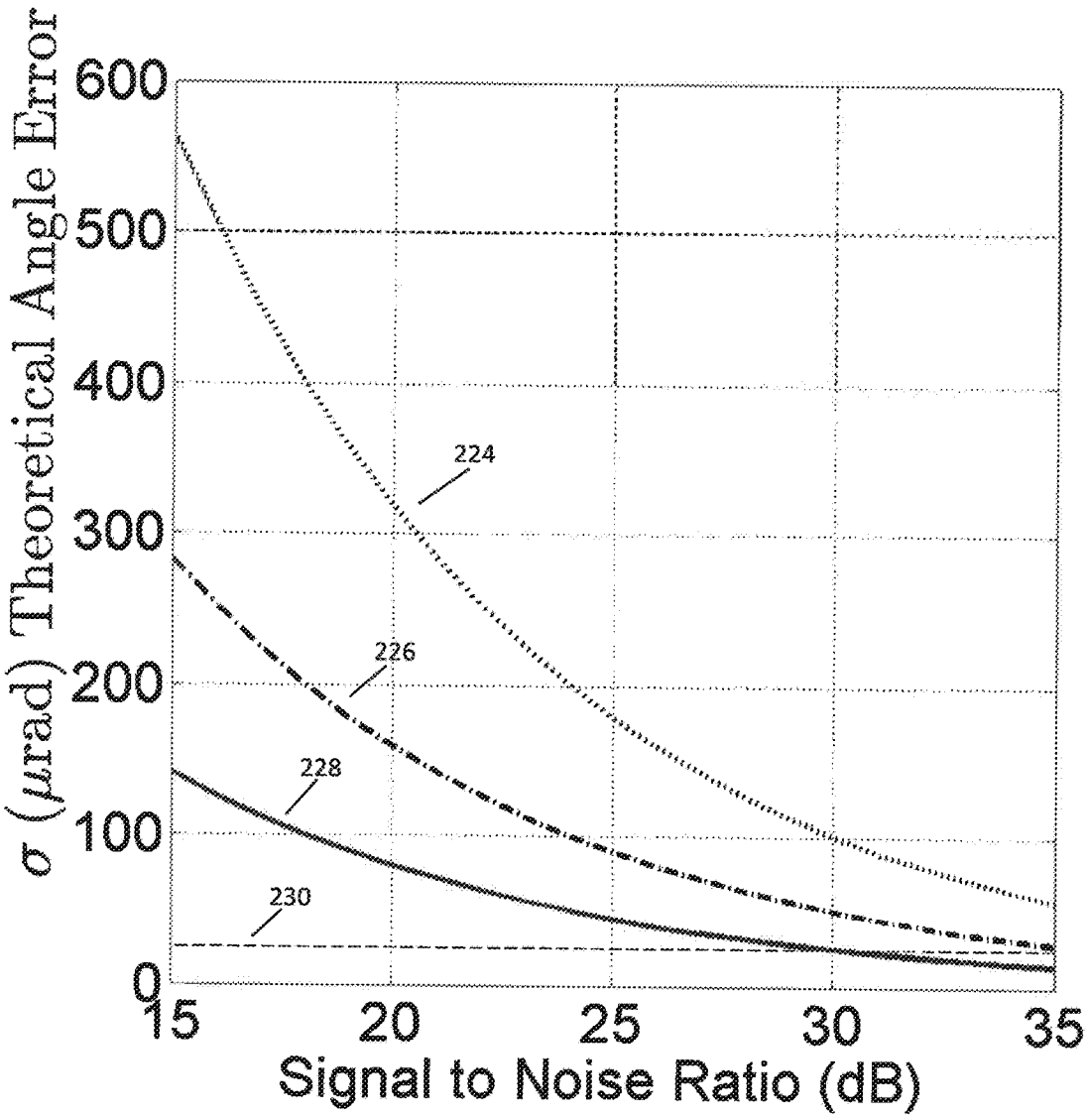
FIG. 2C shows the reduction in angle error with an OI compared to a CI with equivalent signal-to-noise ratio (SNR) according to the principles of the present disclosure.

FIG. 2C depicts the reduction in angle error with an OI compared to the CI with equivalent SNR; the OI radar achieves twice the precision (or the effective baseline) as compared to the CI radar. FIG. 2C compares CI case, D=50$\lambda$, 224 with two OI cases D=50$\lambda$ 226, D=100$\lambda$ 228 against with the ambitious angular precision goal $\sigma_\theta$=25 μrad 230. It should also be noted that with respect to precision, a factor of two improvement in $\lambda$/D is worth a factor of four improvement in SNR.

This increase in the local precision of the angular estimate of $\theta$ due to an increased $$\frac{D}{\lambda}$$

comes at the cost of an increased chance of an ambiguous $\theta$ estimate. Angle ambiguity is a fundamental tradeoff that must be resolved for the potential of this increased estimator precision to have a real world benefit. There are a range of techniques used to suppress interferometer ambiguity. Depending on the particular application a combination of these techniques (discussed briefly herein) can provide effective angle disambiguation.

For interferometer baselines with D>>$\lambda$, $\Delta\phi$ can greatly exceed $2\pi$ so the determination of angle-of-arrival using phase difference $$\sin(\theta) = \frac{\lambda\Delta\phi}{4\pi D} + 2\pi N$$

will be ambiguous by N $2\pi$ wraps where N is the ambiguity number.

Figure 2D:
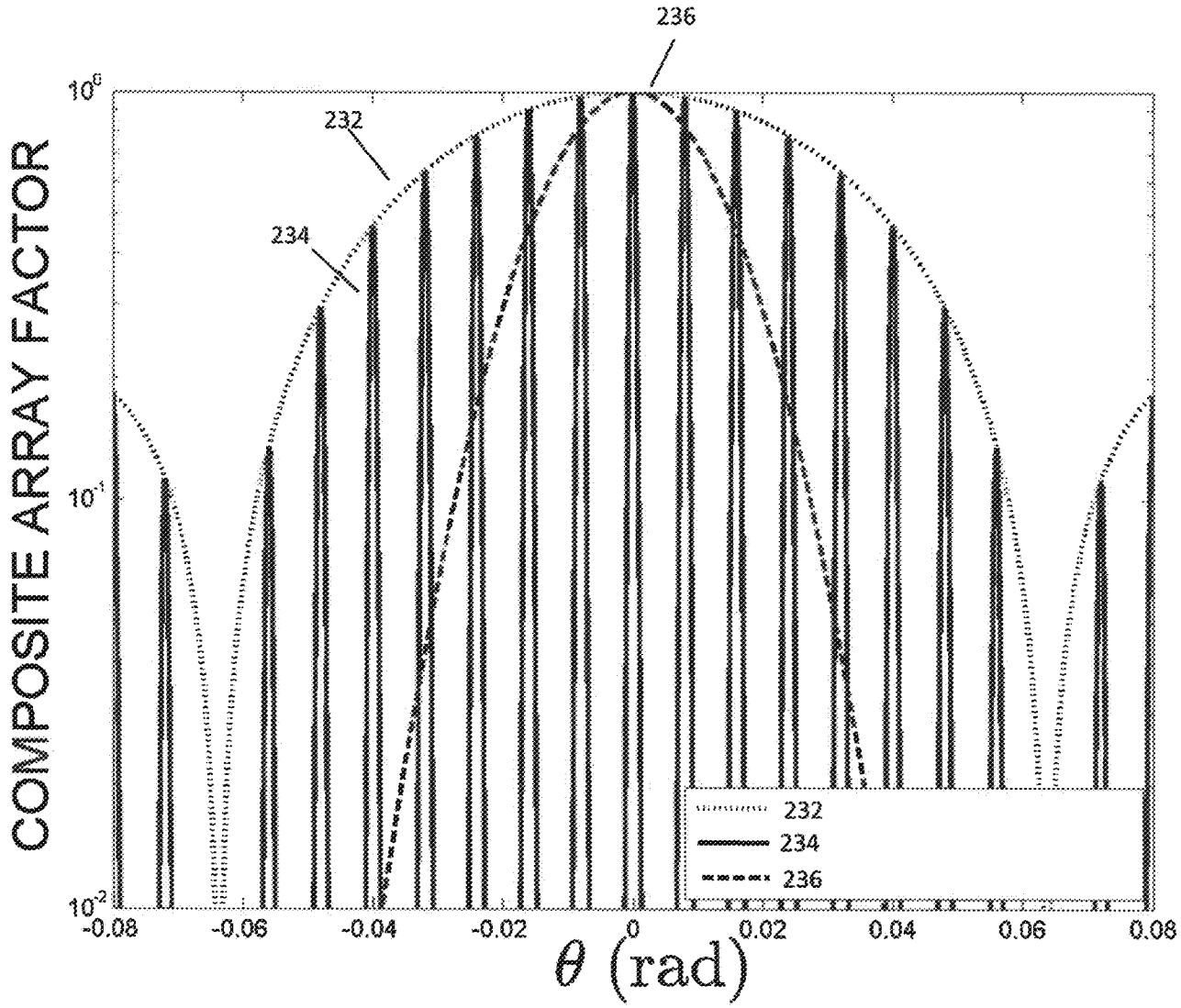
FIG. 2D shows a typical product of a real beam pattern and an electrically large interferometric ambiguity according to the principles of the present disclosure.

FIG. 2D and FIG. 2E depict a typical product of a beam pattern 232 and an electrically large interferometric ambiguity 234. Note that there are many closely spaced $$\frac{\lambda}{D}$$

lobes within the main lobe—all reflecting the same $\Delta\phi$ (modulo $2\pi$ measurement). Two important points should be taken from the "zoom" portion in FIG. 2E: First, $\sigma_\theta^{LI,OI}$, the angular precision of a local radius of a $$\frac{\lambda}{D}$$

lobe 234 trace is much finer than the physical beam pattern. Trying to disambiguate these closely spaced lobes based on a model of the amplitude difference from the main lobe's much broader response will require very high SNR and a highly consistent signal model that is unlikely to be available in a tactical systems.

Still referring to FIG. 2D, The 236 trace represents a prior probability that would be part of a recursive tracking filter. CRLB is the radius of the local lobe. Trace 232 represents the array beam pattern and trace 234 represents the interferometer lobes. The figure shows large interferometer baselines D=100λ gain precision with increased ambiguity.

Another approach to ambiguity mitigation for the OI-tracer application would exploit the high prior information on the projectile trajectory, which provides the opportunity to incorporate accurate kinematic models. In this case, the 236 trace can be interpreted as a prior estimate in a non-linear estimation/tracking formulation where a specific $$\frac{\lambda}{D}$$

lobe's probability is updated via a Bayesian recursion and the local covariance is update via a Kalman Filter. A physical example of exploiting prior information would involve an OI radar with $$\frac{\lambda}{D} = \frac{1}{100}$$

or 1 meter at 100 m range which is still extremely coarse as compared to the "close-in" CEP of the projectile.

For a projectile guidance application, where all the projectiles are cooperative, and there are well timed targets, this approach would be naturally integrated into a tracking filter that can be incorporated the aero-ballistic modeling. A final approach to ambiguity suppression involves multiple measurements at distinct λ/D values forming multiple interferometric baselines. For each available λ/D baseline, the relationship among feasible ambiguity numbers scales (by λ/D) but since the true target angle θ is independent of $$\frac{\lambda}{D}$$

the unwrapped $0^{th}$ lobe experiences no shift.

Figure 2F:
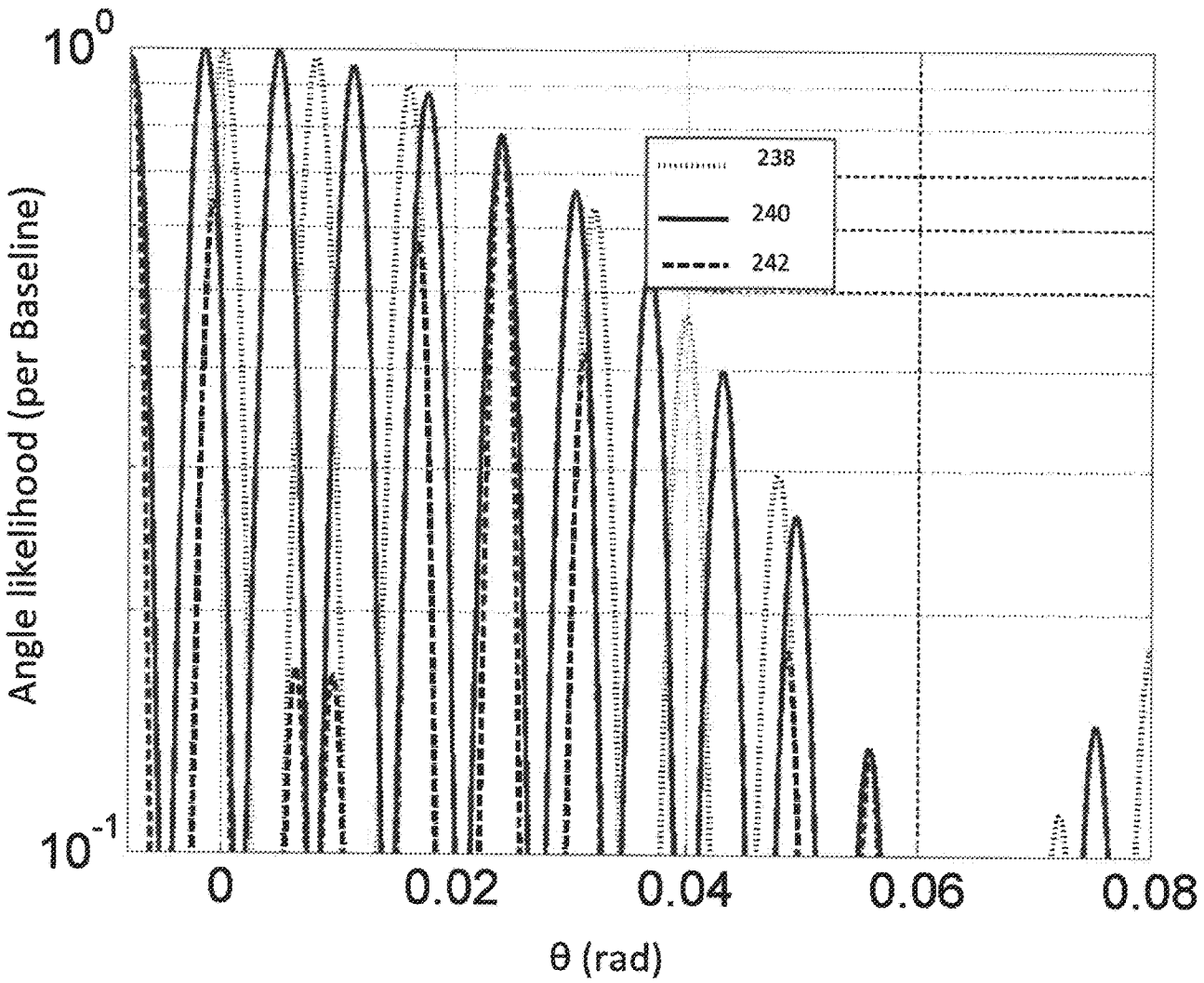
FIG. 2F shows the interaction of two lobe spacings whose product yields a substantial reduction in lobe amplitude according to the principles of the present disclosure.

FIG. 2F depicts (for θ=0) the interaction of two lobe spacings whose product yields a substantial reduction in lobe amplitude. Ambiguity can be suppressed by combining different $$\frac{\lambda}{D}$$

measurements.

$$\sin(\theta) = \frac{\lambda_1 \Delta\phi_1}{4\pi D_1} + 2\pi N_1 \text{ and } \sin(\theta) = \frac{\lambda_1 \Delta\phi_2}{4\pi D_2} + 2\pi N_2$$

This lobe-wise product will only admit an θ ambiguity where the two lobe spaces overlap closely; in the combination of $$\frac{\lambda}{D} = \frac{1}{125}$$

238 and of $$\frac{\lambda}{D} = \frac{1}{100}$$

240 or the 125/100 case, the first significant overlap 242 occurs at the $5^{th}$ $$\frac{\lambda}{D} = \frac{1}{125}$$

lobe and the $4^{th}$ $$\frac{\lambda}{D} = \frac{1}{100}$$

lobe. Hence, there is another ambiguity suppression approach that involves the projectile priors and the interferometer design. In sum, achieving very high precision angle and trajectory estimates via large baseline interferometry incurs some additional complexity of angle ambiguity. Successful mitigation of the ambiguity challenge in an operational system requires integration of the interferometer, array, and aero-ballistic modeling—the details each depending on the particular system configuration under consideration.

In certain embodiments of the system of the present disclosure, the RF system via an orthogonal interferometry (OI) reference frame operates at a frequency of about 5-10 GHz and has a signal-to-noise ratio (SNR) of about 20 dB. In some embodiments, the antenna gain is about 15-20 dB. In some cases, the baseline is about 1.5 m with an angular precision of less than 1 mrad. In some cases, the angular accuracy is about 0.45 mrad. This accuracy is in contrast to conventional radar systems that have angular accuracy of about one to two degrees. Conventional radar systems are also limited by bandwidth. Additionally, radar has cross range resolution at 100 km of about 2.5 km (1.5° beam width) as compared to a 45 m cross range resolution for the RF/OI system disclosed herein. At 50 km, the present system has 22 m accuracy (based on resolution only and all other errors nulled). The radar inaccuracy uses the SAL seeker, IMU, or imaging system at the end of the asset trajectory to correct the large cross range error—2.5 km. In the IO case the cross range error is about 45 meters, which is somewhat large for a desired CEP 30 meters, but is relatively close, and a more accurate OI illuminator can be used to drive error down further by raising bandwidth for the data stream to 200 Hz and averaging it down to half the error. This accuracy provides for accurate hand-off positioning. In certain embodiments, by increasing the bandwidth of the data stream to 200 Hz, the averaging can increase the overall accuracy by 2 to 3×, thereby negating the need for a terminal seeker and meeting respectable CEP of 30 meters. The present system provides actual location within GPS norms. In contrast, conventional radar systems produce a beam that is too broad to implement an angle transfer as described herein.

In some cases, the power requirement for the system ranges from about 100-200 W. The power needed is much lower than for a conventional radar system (e.g. 100 kW). Additionally, the RF/OI system is preferred due to inherent jamming resistance as compared to radar systems. In some embodiments, the projectiles have rear looking antennas for use with the RF/OI system. In some cases, the RF/OI illuminator can control multiple weapon batteries or UAV against multiple targets. The RF/OI reference frame is analogous to the localized GPS where several weapons platforms, air vehicles, and weapons can use the same RF/OI reference frame for navigation. In some cases, the coded pulse series for the system of the present disclosure is about 1.7 μsec which encapsulates the RF/OI waveform. The pulse waveform can be coded for simple operation where the issue of multipath is minimal (ground to air or air to ground scenarios) or heavily reliant on bandwidth/frequency diversity to process out the impact of multipath (ground to ground engagements).

The RF/OI illuminator generates a reference frame analogous to GPS in a local domain or engagement. The system can be deployed aligned to latitude and longitude coordinates by orienting the system to earth's latitude/longitude grid or as a completely independent reference system. In all cases the RF/OI illuminates the reference frame where the flight vehicles determine the azimuth and elevation position relative to the RF/OI illuminator (aligned to the earth or not) and the RF communications link via range tracking filter determines the third component (range) of a polar coordinate system. The polar coordinate system in one example is an earth coordinate system by orienting the illuminator to an earth latitude/longitude grid. In another example, the asset operates in the polar coordinate system relative to the illuminator and receives earth coordinate information from the RF communications link that allow the asset to convert to the earth coordinate system.

In certain embodiments, the illuminator is a wide field of view (FOV) system that provides for all assets with the same signal. The RF communications link provides the unique information for each asset. Information could include, orientation to earth's coordinate's, target's location, target type, waypoints for the vehicle flight path, fusing parameters, and the like.

Figure 3:
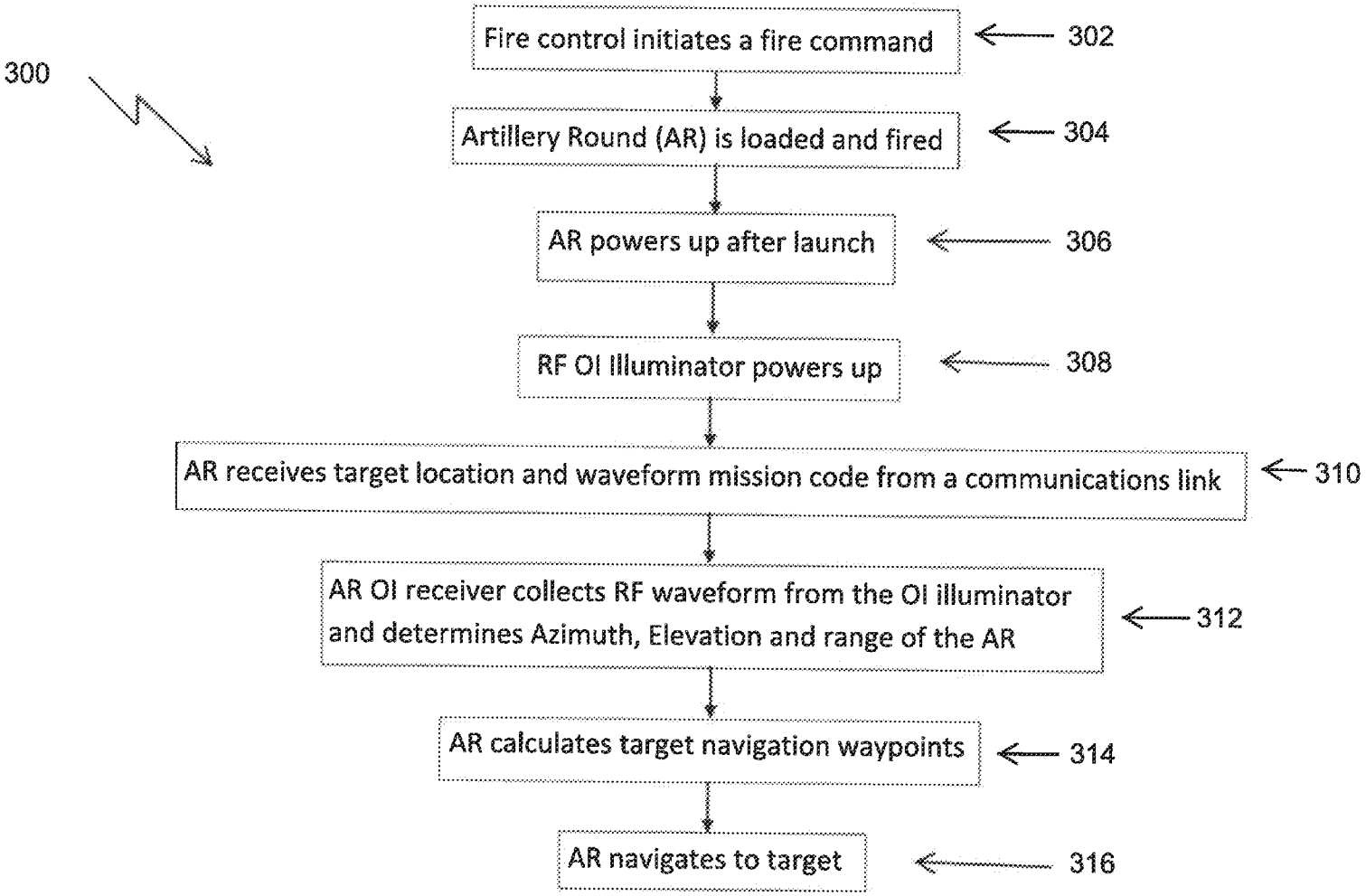
FIG. 3 is a flow chart of some of the functional elements for one embodiment of the system of the present disclosure.

FIG. 3 depicts a flow chart 300 of some of the functional elements prior to any hand-off for one embodiment of the system of the present disclosure. More specifically, in this embodiment, a fire control system initiates a fire command for a single asset 302. In this case, the asset is an artillery round (AR) or other munition. The AR is then loaded and fired 304. The AR is powered up after launch 306. In some embodiments, the AR has a rear-facing RF detector. In some cases, the AR has a communications module for receiving and/or transmitting information to a fire control system allowing updated commands and information. In certain embodiments, the AR has an on-board processor, memory, and/or additional detectors for use in guidance of the AR to a target, particularly for the terminal guidance. In this example, the RF/OI illuminator powers up after the launch of the AR 308 or is already powered up and projecting the frame having waveforms that are received by the AR. While it can be pre-programmed prior to launch, in one embodiment the AR receives updated target information and mission code data from an RF communication link 310 after launch. The RF detector on the AR also collects the RF/OI waveform data from the RF/OI illuminator and determines the azimuth and elevation data, and processes range data from the RF communications link to provide guidance instructions to bring the projectile to the target 312. The AR in one example calculates target navigation waypoints 314 as it navigates to the target 316. If there is a hand-off to a short term guidance system, the short term guidance may use the waypoints but also is able to switch to the short term guidance system such as the SAL seeker or imaging system. If unable to use the short term guidance system, the projectile can continue to use the calculated target navigation waypoints.

Figure 4:
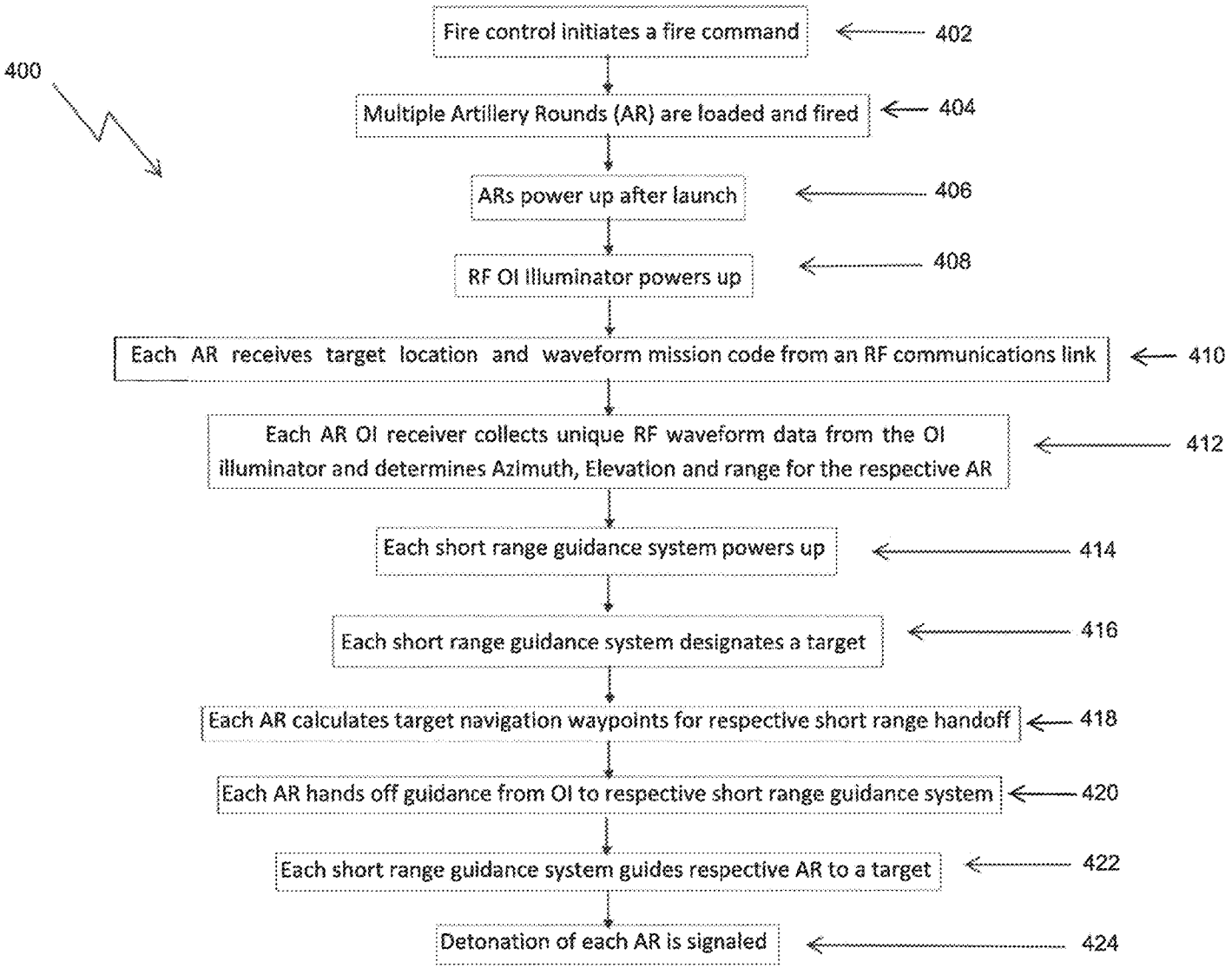
FIG. 4 is a flow chart of some of the major functional elements for another embodiment of the system of the present disclosure for guiding multiple assets.

FIG. 4 depicts a flow chart 400 of some of the functional elements for one embodiment of the system of the present disclosure is shown. More specifically, in this embodiment, a fire control system initiates a fire command for multiple assets 402. The fire control system in one example is a separate unit apart from the RF/OI illuminator but in other examples they are integrated together. In this case, the assets are artillery rounds (ARs) or other munitions. The ARs are loaded and fired 404 such as from a launcher. The ARs are generally powered up after launch 406, although in some cases the electronics are powered up prior to launch to obtain initial target information and mission data. In this embodiment, the AR has a rear-facing RF detector that allows reception of the RF/OI waveforms the form the reference frame as well as RF communications such as updated mission codes and target data. In one example the RF communications enables processing of the range information. In some cases, the AR has a communications module for receiving and/or transmitting information to the fire control system. In certain embodiments, each AR has an on-board processor, memory, and/or additional detectors for use in guidance of the AR to a target. As detailed herein, the RF/OI illuminator projects the reference frame and is either powered up after the launch of the ARs 408 or may be already powered up and projecting the frame for subsequent AR.

In some embodiments, multiple rounds are coordinated in one RF/OI reference frame. In some cases a full battery of Howitzers, or the like, are used and each round has customized trajectories for the particular target type or for masking the round's location. In some cases this is limited to the weapons control authority. Artillery with a limited control authority only maintains the pure ballistic trajectory, thereby limiting the curve one can add to the flight path. Mortars with larger control features can be aimed off target by several degrees and brought back on the correct flight path to engage the target. The Azimuth induced curve in the flight path provides a false launch location from the counter battery radar.

In certain embodiments, the RF/OI reference frame is extended to about 100 km and provides location to within about 100 m. In some cases the reference frame is extended to about 50 km and provides location to within about 50 m. The system utilizes one way illumination with rear-looking antennas on the projectiles and provides for jam hardening capability.

In some cases the round may be programmable during the initial flight path, which can reduce the time to fire. By equipping the RF/OI reference frame with a high quality north seeker, the system allows for "on the go" alignment for all of the rounds. No azimuth aiming is required with the RF/OI reference frame, and only minimal elevation adjustment is needed to account for a range differential. The RF/OI can be designed to cover various fields of engagement. In some cases, the field of engagement may be 10, 20 or 30 degrees.

Still referring to FIG. 4, each of the multiple rounds receives target information and unique waveform mission codes from an RF communication link, or the like 410. An RF detector on each AR collects the RF/OI waveform data from the RF/OI illuminator and determines the azimuth and elevation, and uses asset data to obtain the range from each asset to the target 412. The RF/OI method requires only minimal electronics cost to be embedded into each round, such as an RF receiver and RF apertures. In certain cases, the system hands off the guidance for the multiple rounds at about six to ten km from the target to a short range guidance system. Each short range guidance system powers up 414 and each short range guidance system designates a target 416. Each AR calculates target navigation waypoints along the flight path for use in a respective short range hand-off 418. In one embodiment the AR switches AR guidance from the RF/OI system to a respective short range guidance system 420 as the projectile approaches the target and is unable to stay connected with the RF/OI illuminator. Each short range guidance system guides a respective AR to a target 422. Detonation of the AR can be signaled 424 or can be internal such as timed, altitude or otherwise. In some cases, the detonation is signaled by a fire control system. In other cases, detonation is signaled by the short range guidance system at a certain distance. In some cases, detonation is signaled by the short range guidance system at a certain time point or Height of Burst (HOB) sensor.

In one example, the RF/OI illuminator's guidance of a munition is handed off to a SAL seeker, or the like. There, the round is equipped with laser detection ROIC or the like. In some cases, the short range guidance system is small, e.g., about 1 $in^3$, including the optics. In one embodiment, the SAL seeker is capable of detection at 10 km with 1 mrad target angle error with a FOV ranging from 40 to 70 degrees. In certain embodiments, a SAL seeker located on the front of the asset is guided by a designator (laser) coming from a forward observer on the ground, a UAV, or an aircraft. In some cases, the SAL seeker is equipped with full counter countermeasure (CCM) filtering with spatial and temporal filtering and/or full pulse repetition frequency (PRF—used to distinguished between multiple designators) and pulse interval modulation (PIM—used in a heavy jammer environment) decoding with multiple designators within the FOV.

In some cases, the RF/OI illuminator's guidance of a munition is handed off to an image based homing and navigation system. In certain embodiments, the short range guidance system utilizes image ATR (automatic target recognition). ATR is generally better suited for fixed targets, including, but not limited to buildings or structures. A series of images are stored in a database and either loaded onto a round or accessible by a round. The images are for areas of interest and/or for particular types of assets. When a round is within a certain range, the round can "recognize" the target form the images stored in the library. In some cases the library of images comprises items viewed at a distance of 40-50 meters. The imagery can be used to refine the weapons aimpoint to hit a specific place on target (section of a building) or look for a type of target in an open area (tank, artillery, etc.).

In some cases, the RF/OI illuminator's guidance of a munition is handed off to an IMU during the final four to five seconds, or the terminal phase. In some cases, this method is utilized in a grid pattern for area bombing. The RF/OI can be used to calibrate the IMU drift prior to engagement thereby reducing cost and maintaining weapon accuracy.

Figure 5:
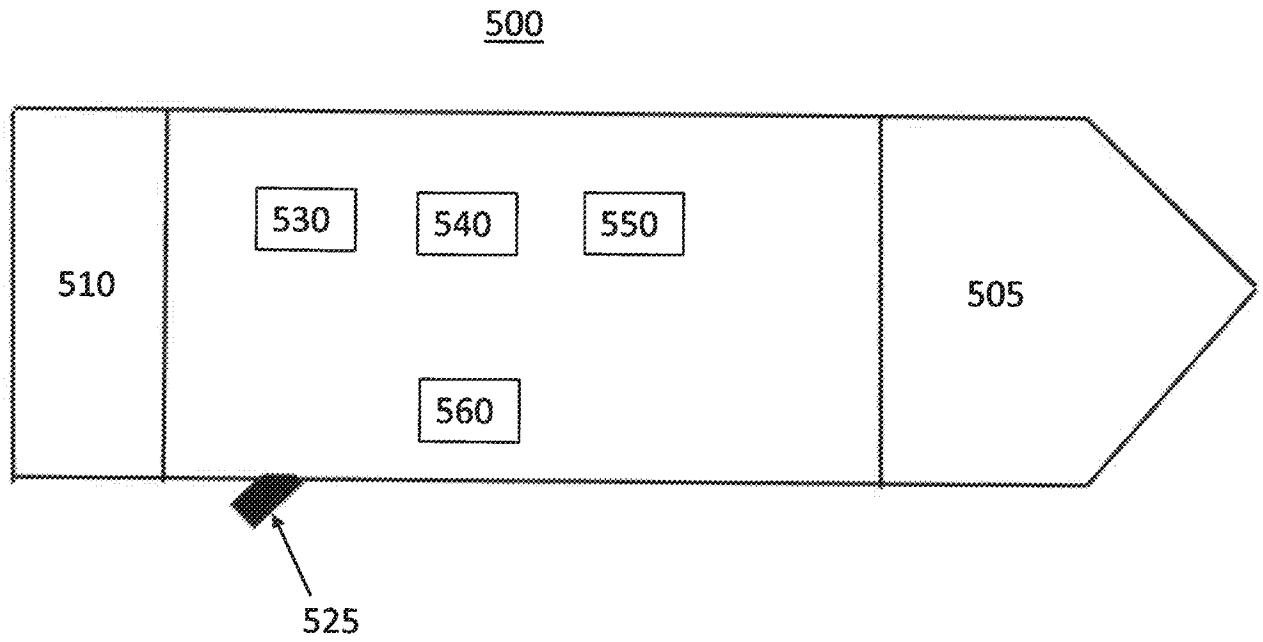
FIG. 5 is a depiction of the projectile according to one embodiment.

Referring to FIG. 5, a perspective view of the projectile 500 is shown that employs the RF/OI processing for navigation and guidance to the target. The projectile 500 can be a missile, rocket, artillery round or similar guided munition. The projectile has a front portion 505 that that typically houses the warhead and fuze elements such that the fuze detonates the warhead at the appropriate point for the desired result. On the rear or tail portion of the projectile 510 is an optional rocket engine that can be deployed to provide thrust to extend the range of the projectile. In one example, the projectile is launched without a rocket engine such as from a launch platform that achieves a certain altitude and is guided to the target. Examples of launch platforms include anti-tank guns, mortars, howitzer, field guns and railguns. The projectiles from the launch platforms may or may not have a rocket engine.

Referring again to FIG. 5, the midsection tends to house the electronics, communications, and guidance/navigation systems. A rear facing antenna 525 is typically use to obtain the RF/OR waveforms for the reference frame that enable determination of the azimuth and elevation with respect to the illumination system. In one example, the processing involving firmware/software is performed on one or more processors that execute software residing on memory that is coupled to the processors. While labels are placed on certain items for descriptive purposes, the processing may be all done on a circuit card for have the processing technology. In this example an RF receiver 530 is coupled to the antenna 525. The RF receiver 530 has a downconversion stage to process the analog inputs from the antenna and may include mixer(s), filter(s) and low noise amplifier(s) to process the analog signals. The downconverted signals are input to an analog-to-digital converter (ADC) to provide digital information that is then processed by one or more processing units such as in a digital signal processor.

A short range guidance section 540 is used when the projectile reaches a hand-off point near the terminal end of the trajectory near the target area. The short range guidance section 540 in one example is a SAL seeker that receives a signal such as reflected laser signal from the target. Another example is an imaging section that uses a camera to view the target area and compares the captured image to stored images to identify the target and. In yet a further example, since the projectile is close to the target and was tracking to the target, an inertial measurement unit (IMU) can be used to keep the projectile in a proper orientation and path to the target.

A guidance, navigation and control section 550 is the digital processing section and is coupled to memory containing various instruction and routines and controls certain operation of the projectile. The signal processing of the OI includes decoding against a particular code and exploiting the cross-correlation suppression of the orthogonal coded waveforms. The azimuth and elevation data is obtained from the decoding. The RF communications such as the mission data and range data are also processed by the digital signal processor. Guidance information from the short range guidance section 540 is processed and control instructions are generated to direct the projectile to the target.

A control actuation system (CAS) 560 receives guidance controls and instructions to manipulate fins and canards (not shown) to steer the projectile. If the projectile has a rocket engine, that can also be employed to assist in reaching the target.

It will be appreciated from the above that portions of the invention may be implemented as computer software, which may be supplied on a storage medium or via a transmission medium. It is to be further understood that, because some of the constituent system components and method steps depicted in the accompanying Figures can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture. The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A flight management system, comprising:

a radio frequency orthogonal interferometry illuminator configured to generate a reference frame projected in the direction of a target area having radio frequency orthogonal interferometry waveforms and to further provide radio frequency (RF) communications comprising range information and mission information;

at least one projectile configured to receive the radio frequency orthogonal interferometry waveforms and the range information and mission information;

a short range guidance system on the projectile configured to provide guidance of the projectile from a hand-off point to the target area; and a non-transitory computer-readable storage medium carried by the projectile having a set of instructions encoded thereon that when executed by one or more processors, provide guidance and navigation of the projectile, the set of instructions being configured to cause the one or more processors to perform:

processing azimuth and elevation information from the radio frequency orthogonal interferometry waveforms;

processing the range information and mission information from the RF communications;

determining polar coordinates of the projectile using the azimuth, elevation and range information, wherein the polar coordinates are relative to the radio frequency orthogonal interferometry illuminator;

guiding the projectile along a trajectory within the reference frame to the hand-off point;

switching to the short range guidance system at the hand-off point; and guiding the projectile from the hand-off point to the target area using the short range guidance system.

2. The flight management system according to claim 1, wherein the short range guidance system is at least one of a semi-active laser (SAL) seeker, an inertial measurement unit, and an image based homing and navigation system.

3. The flight management system according to claim 1, wherein the projectile is directed to the target without using a global positioning system (GPS).

4. The flight management system according to claim 1, wherein the polar coordinates are earth coordinates by orienting the radio frequency orthogonal interferometry illuminator to an earth latitude/longitude grid.

5. The flight management system according to claim 1, further comprising a range tracking filter used to obtain the range information.

6. The flight management system according to claim 1, wherein the mission information provides unique information for each projectile comprising at least one of orientation to earth coordinates, target location, target type, waypoints, and fusing parameters.

7. The flight management system according to claim 1, wherein the at least one projectile is a plurality of artillery rounds configured to use the mission information to form a grid pattern proximate the target area.

8. The flight management system according to claim 1, wherein the projectile further comprises an RF receiver, a guidance navigation and control section, a control actuation system, a warhead, a fuze and at least one detector.

9. The flight management system according to claim 1, wherein a maximum location of the hand-off point along the trajectory is at a boundary of the reference frame.

10. The flight management system according to claim 1, wherein the radio frequency orthogonal interferometry illuminator mitigates jamming by controlling properties of the radio frequency orthogonal interferometry waveforms including at least one of pulse width, frequency, and use of frequency hopping.

11. The flight management system according to claim 1, further comprising a rear facing antenna on the projectile.

12. The flight management system according to claim 1, further comprising a north finding device coupled to the radio frequency orthogonal interferometry illuminator.

* * * * *